US007254467B2

(12) United States Patent
Fries et al.

(10) Patent No.: US 7,254,467 B2
(45) Date of Patent: Aug. 7, 2007

(54) DIGITAL TRAIN SYSTEM FOR AUTOMATICALLY DETECTING TRAINS APPROACHING A CROSSING

(75) Inventors: Jeff Fries, Kansas City, MO (US); Roger Fitz, Lee's Summit, MO (US); Robert M. Morris, Blue Springs, MO (US)

(73) Assignee: General Electric Company, Schenectady, NY (US)

( * ) Notice: Subject to any disclaimer, the term of this patent is extended or adjusted under 35 U.S.C. 154(b) by 240 days.

(21) Appl. No.: 10/743,591

(22) Filed: Dec. 22, 2003

(65) Prior Publication Data

US 2004/0181321 A1 Sep. 16, 2004

Related U.S. Application Data

(60) Provisional application No. 60/447,195, filed on Feb. 13, 2003.

(51) Int. Cl.
*G06F 7/00* (2006.01)

(52) U.S. Cl. ..... 701/19

(58) Field of Classification Search ..... 701/19; 246/122 R

See application file for complete search history.

(56) References Cited

U.S. PATENT DOCUMENTS 3,603,786 A 9/1971 Peel 4,107,616 A * 8/1978 Moorey ..... 327/22

(Continued)

FOREIGN PATENT DOCUMENTS

EP 0539046 4/1993

OTHER PUBLICATIONS

"Four-Quadrant Gate Highway-Crossing Warning System," printed from www.switch.com/products/4quadbrochure.htm, 5 pages, Feb. 2, 2003.

(Continued)

*Primary Examiner*—Thu V. Nguyen
(74) *Attorney, Agent, or Firm*—Senniger Powers

(57) ABSTRACT

A system for automatically detecting the presence of a train located within a detection or surveillance area of a railroad track associated with a railroad grade crossing. The system includes a transmitter unit that transmits a detection signal. The system also includes a receiver that receives a detection signal. A receiver unit receives one or more signals. A processor coupled to the receiver unit is configured to process the received signals and determine the presence, absence or movement of a train or signal within the detection or surveillance area. The processor unit is configured to initiate an action when the processor determines the presence or the absence of the train or one or more detection signals. The current invention also includes a method for automatically detecting the presence of the train located within a surveillance area associated with a railroad grade crossing area.

25 Claims, 7 Drawing Sheets

U.S. PATENT DOCUMENTS

| | | | |
|---|---|---|---|
| 4,304,377 | A | 12/1981 | Pitard |
| 4,324,376 | A | 4/1982 | Kuhn |
| 4,581,700 | A | 4/1986 | Farnham et al. |
| 4,868,538 | A | 9/1989 | Ballinger et al. |
| 5,470,034 | A | 11/1995 | Reeves |
| 5,742,156 | A | 4/1998 | Sezi |
| 5,924,652 | A | 7/1999 | Ballinger |

OTHER PUBLICATIONS

Marbury, "Passing Trains Activate Crossing Signals," printed from www.srmduluth.org/Features/crossing.htm, 2 pages, Jul. 21, 2002.
"Safetran 3000 Grade Crossing Predictor and 2000 Motion Sensor Design & Commissioning," printed from www.westsig.com.au/DEPT/Marketing/Common/datasheets.nsf/09797a33a15a4a10ca…, 3 pages, Sep. 30, 2001.
"Engineering," Rail Manual, Florida State, 20 pages, Mar. 2000.

* cited by examiner

DIGITAL TRAIN SYSTEM FOR AUTOMATICALLY DETECTING TRAINS APPROACHING A CROSSING

This application claims priority from Provisional Application No. 60/447,195, filed on Feb. 13, 2003.

FIELD OF THE INVENTION

The invention relates generally to railway road crossing systems. More particularly, the invention relates to a system and method for automatically detecting the presence and movement of a railway vehicle within a detection area of a railroad track and the control of the road crossing system.

BRIEF DESCRIPTION OF THE INVENTION

There is a need for a train detection system and method for railroad grade crossings that provides for an accurate detection of trains approaching, traversing, resting within and exiting the detection area associated with a railroad grade crossing which adequately covers the detection area and that is immune from external interference and noise.

There is also a need for a system that is less costly than currently available systems. Such a system and method monitors the railroad track associated with the railroad grade crossing and determines when a train is within the railroad grade crossing detection area by detecting only the well-defined detection signal, thereby excluding all possible echoes, interference signals and noise.

The present system provides improvements in the transmission of the track circuit signal to reduce the total harmonics that are transmitted on the railroad track. The system also provides for improvements in the detection of the received signals, the filtering of the received signals, and the processing of the received signals to determine the presence and signal characteristics of the received track circuit signal. These improvements enhance the ability of the track circuit system to operate in noisy and harsh environments and to detect the presence, movement, location and speed of a train. Other aspects of the present system provide for the decrease in the separation required between operating frequencies of track circuit systems, an increase in the number of compatible operating frequencies within the allocated frequency band for such systems, and improved frequency management of the operating frequencies for railway track circuit equipment. Another aspect of the present system provides for improvements in the design, cost, implementation and methods of operations of track circuit detection equipment.

SUMMARY OF THE INVENTION

In one aspect of the invention, a train detection system is provided for detecting the presence and/or position of a railway vehicle within a detection area of a railroad track having a pair of rails and an identified impedance within the detection area. The presence and position of the railway vehicle within the detection area changes the impedance of the track. The train detection system includes a first transmitter connected to the rails of the railroad track for transmitting along the rails a first signal having a predetermined magnitude and a predetermined operating frequency. A receiver connected to the rails receives the first signal. A first data acquisition unit coupled to the first transmitter and the receiver is responsive to the transmitted first signal and the received first signal to generate first multiplexed analog signals that represents the transmitted first signal and the received first signal. A first converter converts the first multiplexed analog signals into a plurality of first digital signals that correspond to the transmitted first signal and the received first signal. A processor is responsive to the first digital signals for processing the first digital signals to determine the frequency and magnitude of the transmitted first signal and the received first signal.

In another aspect of the invention, a train detection system is provided for detecting the presence and/or position of a railway vehicle within a detection area of a railroad track having a pair of rails and an identified impedance within the detection area. The presence and position of the railway vehicle within the detection area changes the impedance of the track. The train detection system includes a first transmitter connected to the rails of the railroad track for transmitting along the rails a first signal having a predetermined magnitude and a predetermined operating frequency. A second transmitter connected to the rails of the railroad track transmits along the rails a second signal having a predetermined magnitude and a different predetermined operating frequency. A receiver connected to the rails receives the first and second transmitted signals. A first data acquisition unit coupled to the first transmitter and the receiver is responsive to the transmitted first signal and the received first signal to generate first multiplexed analog signals representing the transmitted first signal and the received first signal. A second data acquisition unit coupled to the second transmitter is responsive to the transmitted second signal and a received second signal to generate second multiplexed signals representing the transmitted second signal and the received second signal. A first converter converts the first multiplexed analog signals into a plurality of first digital signals that correspond to the transmitted first signal and the received first signal. A second converter converts the second multiplexed analog signals into a plurality of second digital signals corresponding to the transmitted second signal and the received second signal. A first digital signaling processor responsive to the first digital signals processes the first digital signals to determine if the frequency of the received first signal is within a first passband frequency range. The first passband frequency range is a function of the frequency of the transmitted first signal. A second digital signaling processor responsive to the second digital signals processes the second digital signals to determine if the frequency of the received second signal is within a second passband frequency range adjacent to the first passband range. The second passband frequency range is a function of the frequency of the transmitted second signal. A processor responsive to the first digital signals processes the first digital signals to determine the frequency and magnitude of the transmitted first signal and the received first signal to determine an impedance of the track as an indication of the presence and/or position of a train within an approach detection area when the received first signal is within the first passband frequency range. The processor also responsive to the second digital signals processes the second digital signals to determine if the magnitude of the received second signal is above or below a threshold value as an indication of the presence of a train within an island detection area when the received second signal is within the adjacent passband frequency range.

In yet another aspect of the invention, a method is provided for detecting the presence and/or position of a railway vehicle within a detection area of a railroad track having a pair of rails and an identified impedance within the detection area. The presence and position of the railway vehicle within the detection area changes the impedance of the track. The method includes transmitting along the rails a first signal having a predetermined magnitude and a predetermined operating frequency. The method also includes receiving the first signal being transmitted along the rails. The method also includes generating a first analog signal that represents the transmitted first signal and the received first signal. The method further includes converting the first analog signal into a plurality of first digital signals that correspond to the transmitted first signal and the received first signal. The method further includes processing the first digital signals to determine the frequency and magnitude of the transmitted first signal and the received first signal to determine an impedance of the track as an indication of the presence and/or position of a train within an approach detection area.

Other aspects and features will be in part apparent and in part pointed out hereinafter.

DESCRIPTION OF THE INVENTION

Railway road crossing warning systems provide protection of crossings by detecting train presence and motion, and activating the crossing warning systems such as bells, lights, crossing gate arms, within a specified time period before the arrival of a train at the road crossing. Train presence near the crossing and motion towards/away from the crossing is detected by transmitting signals on the railroad tracks. Train presence is detected by receiving the transmitted voltage as propagated over the railroad track as a transmission medium. Train motion is determined by monitoring the current and voltage applied to the railroad track to determine the impedance of the track, from the crossing to the train.

Figure 1:
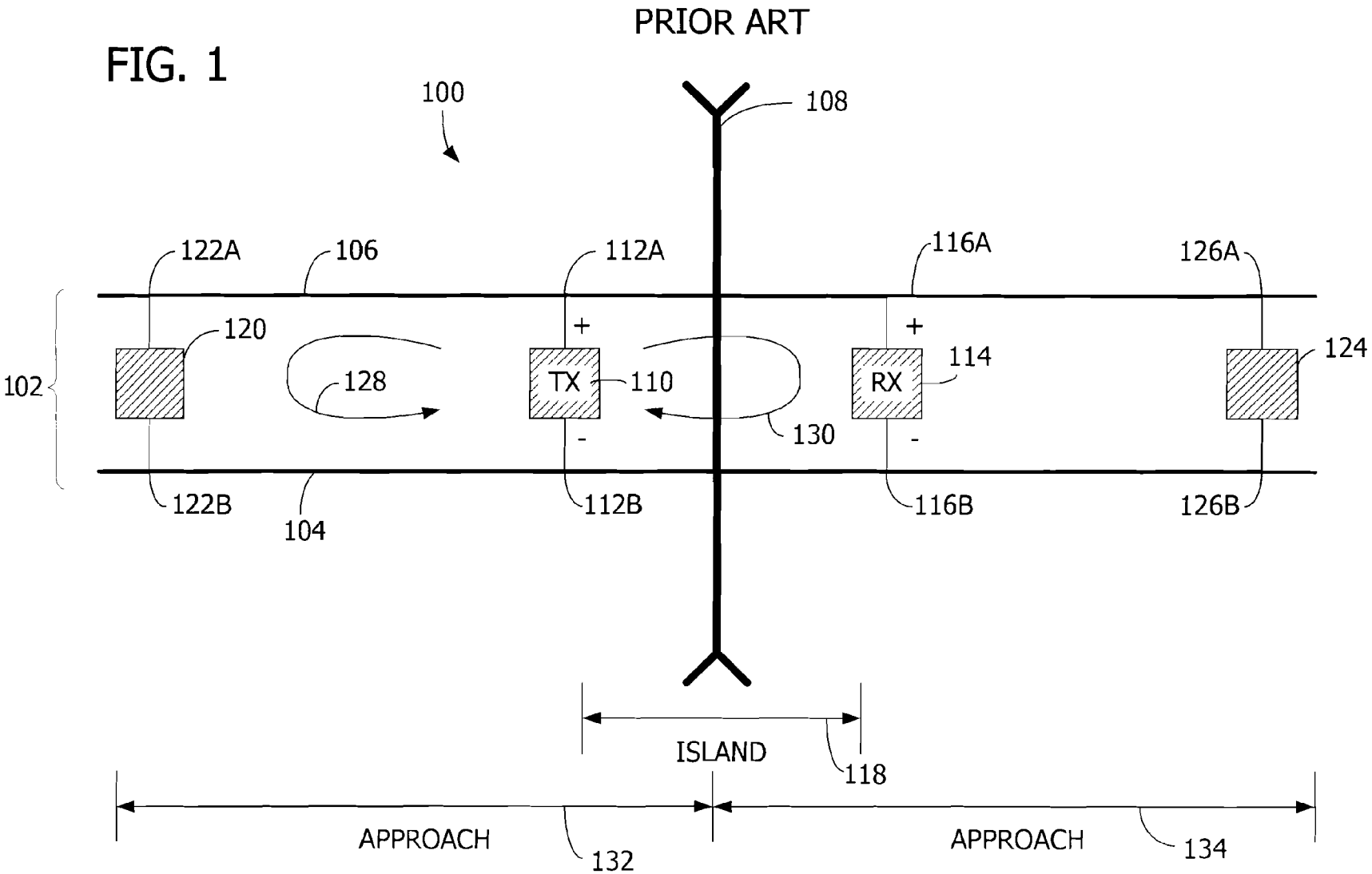
FIG. 1 is a schematic illustration of a railway road crossing detection system for a single road crossing.

FIG. 1 illustrates a typical prior art railroad grade crossing track circuit 100 with a single railroad track 102 that is comprised of a pair of running track rails 104 and 106 and road crossing 108. For proper operation, the railroad track on either side of the road crossing 108 must be monitored for the presence and movement of a train approaching on the track 102 from either side of road crossing 108. The maximum length of a railroad grade crossing system's surveillance area, or effective approach distance, is limited by external conditions and by the frequency of the detection signal applied to the track 102.

A railroad grade crossing warning system employs two different track circuits to perform train motion and presence detection. By measuring the voltage and current and determining the impedance of the track between the crossing and the train, the approach track circuit 128 detects the motion of an approaching train at a distance up to 7,500 feet on either side of the road crossing 108. The approach track circuit 128 determines the distance of the train from the road crossing and detects the movement of the train within the approach track surveillance area 132 and 134. The approach track system measures the voltage, current and impedance and provide this data to an external crossing system that determines the speed of the approaching train and the time for the arrival of the train at the crossing based on the distance and the speed. The presence, position, and arrival time of the train are used to provide a constant arrival time notification of the crossing signal systems. A constant arrival time of at least twenty seconds prior to the arrival of the train that is independent of the speed of the train is often required. The minimum required distance of the surveillance area on either side of the crossing is a function of the maximum speed for a train traversing that section of track and the desired warning time.

The island track circuit 130 measures the presence of a train within an "island" which is a section of track in close proximity to the road crossing 108. The island 118 is usually around 100 to 400 feet spanning the road crossing 108. The island 118 provides a secure area that ensures that the crossing warnings systems operate when a train is near or within the island 118. See U.S. Pat. No. 4,581,700.

FIG. 1 further illustrates transmitter 110 with two points of attachment 112A and 112B that attach to the rails 106 and 104 of track 102 on one side of the road crossing 108. The transmitter is positioned between 50 to 200 feet away from the road crossing 108. A receiver 114 also has two points of attachment to rails 106 and 104 of track 102 on the other side of the road crossing 108 from the transmitter 110. The receiver is also typically positioned 50–200 feet away from the road crossing 108. The distance between the transmitter 110 and receiver 114 is referred to as the island 118 with the transmission circuit created on the railway tracks referred to as the island track circuit 130.

At longer distances away from the road crossing 108, on one or both sides of the rail, are termination shunts 120 and 124, which are connected to rails 106 and 104 of track 102 by 122A/122B and 126A/126B, respectively. Shunts 120 and 124 are placed between 300–7500 feet from the road crossing 108. The placement of the shunt is determined based on the speed of the train and the requirement that the road crossing warning system 100 provides at least a twenty second warning to vehicles and pedestrians using road crossing 108. Termination shunts 120 and 124 are frequency tuned to look like a short circuit to the frequency of the approach track circuit 128, thereby creating track circuit 128. This creates a defined surveillance area 132 and 134 on either side of the crossing 108 within which the approach track circuit and system detects the presence or movement of a train. While not necessary, in some prior art installations both the approach track signal 128 and the island track signal 130 are transmitted onto the track 102 via the same leads 112A and 112B. In other embodiments, a separate transmitter 110 may transmit the approach track signal 128 separate from the island track signal 130. Additionally, in other embodiments, a separate receiver 114 may receive the approach track signal 128 separate from the island track signal 130.

The approach track circuit operates in the frequency range of 80–1,000 Hz. The approach track circuit 128 uses a lower range of frequencies compared to the island track circuit 130. As will be discussed, lower frequencies provide for longer distance detection capabilities due to the extended distance over which the impedance of the track is linear as a function of distance. The approach track signal propagates over long distances of track extending out from the crossing (called the approaches). The approaches are terminated by tuned shunts at the endpoints away from the crossing, providing fixed impedance for each approach section at the tuned frequency. The receiver monitors the received voltage and transmitter monitors the transmitted current, which are then used to determine the impedance of the approach track circuit. The system monitors changes in the approach track circuit voltage and current levels. As a train moves into the approach, the axles provide an electrical shunt, which changes the impedance of the approach track circuit as seen by the detection system. The rate of change in this impedance is proportional to the speed of the train, thus providing for the detecting of the movement of the train. Using this information, the system may calculate a time at which the train will be at the crossing. In some systems, a constant warning time can be provided to motorists at the crossing independent of the speed of the train.

The island track circuit 130 operates at higher frequencies to detect the presence of a train in the shorter island surveillance area 118. Typical operating frequencies are in the range of 2 kHz–20 kHz. When a train enters the island area 118, the axle of the train shunts the island signal so that the signal transmitted is prevented from getting to the receiver. In this operation, the island track circuit 130 and detection system determines that the train is in close proximity to the road crossing 108 and ensures that the warning systems are operating, and are not released until the train clears the island. In other island track circuit systems, the island track signal includes randomly generated codes, either on a continuous or burst basis. In these systems, when one or more consecutive codes fail to be received by the receiver, the warning system is activated. As a safeguard, the system is typically not deactivated, e.g., the all-clear signal is sent, until a predefined number of correctly received consecutive codes have been received.

However, in the prior art, it has been difficult to operate train detection systems in an optimal manner where there is noise in the frequency spectrum utilized by the track circuit systems. This is especially the case where the optimal design requires the use of lower operating frequencies due to the required surveillance distance. For example, where tracks have significant 50 Hz or 60 Hz noise associated with electrified track or near high power electric power lines, the use of lower operating frequencies for track circuits is prohibited due to poor accuracy of the detection system near the frequency of the noise. Additionally, adjacent and overlapping track circuit systems create design limitations related to the optimal selection of compatible frequencies to survey the desired distances of track.

Figure 2:
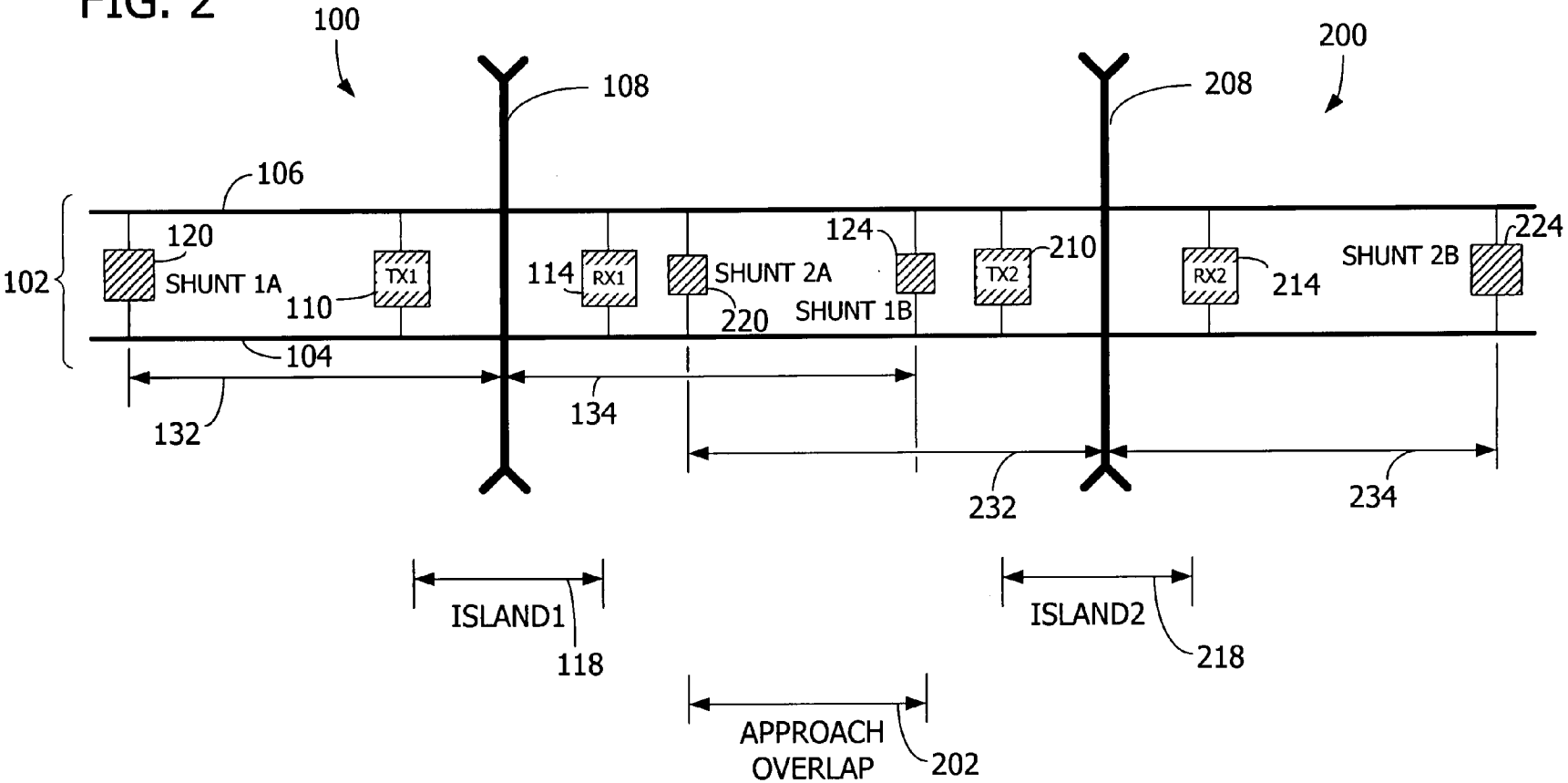
FIG. 2 is a schematic illustration of two adjacent and overlapping railway road crossing detection systems.

FIG. 2 illustrates the practical problem associated with adjacent road crossings and the associated adjacent and overlapping track circuit systems. On the left of FIG. 2 is a first track circuit system 100 associated with a first road crossing 108, which is similar to that described above in FIG. 1. A first transmitter 110 and a first receiver 114 define a first island surveillance area 118. First shunts 120 and 124 define the first left and first right approach surveillance areas 132 and 134, respectively.

Similarly, a short distance from first road crossing 108, is second road crossing 208. The second track circuit system 200 also operates on the same railroad track 102. A second transmitter 210 transmits the island and approach track circuit signals associated with the second track circuit 200. The second transmitter 210 in conjunction with a second receiver 214 defines the second island surveillance area 218. In this case, the second island 218 is adjacent to but not overlapping with the first island. However, in operation, it is likely that the distance between the first road crossing 108 and the second road crossing 208 results in an area of overlap between approach surveillance areas. Second shunts 220 and 224 define the left and right second approach surveillance areas, 232 and 234, respectively. In this illustration, the adjacent road crossings are positioned at a distance that results in the overlap of the right first approach area 134 with the left second approach area 232 thereby creating an approach overlap 202. This results from the required placement of second shunt 220 within the track circuit defined by first shunt 124. The adjacent and overlapping approach track circuit system must operate at a frequency that does not interfere with or negatively affect the operation of the adjacent overlapping track circuit. Prior art systems require the deployment of complicated and costly analog bandpass filters to discriminate between the frequencies of overlapping approaches. Additionally, the adjacent overlap requires that frequency selection be designed to ensure continued operations of both systems. The selection of frequencies may be less than optimal or desirable due to the need to provide necessary approach track circuit distance for the appropriate detection of trains by both systems. The selection of frequencies is directly related to the transmission or impedance characteristics of the track 102 for an operating frequency and the required approach length for a maximum speed train.

As discussed above, the track circuit system transmits a signal on the track in order to detect the presence, position and movement of a train on the track. The railroad track is a communications medium for various track circuit equipment, cab signaling equipment as well as for the provisioning of electric power on electrified lines to provide power to electrified locomotives. Additionally, the tracks pick up electromagnetic radiation from many sources including proximate electric power lines, signals transmitted by adjacent tracks, etc. As such, the electronic signals on the track comprise a myriad of signal levels, frequencies, and harmonic content.

Figure 3:
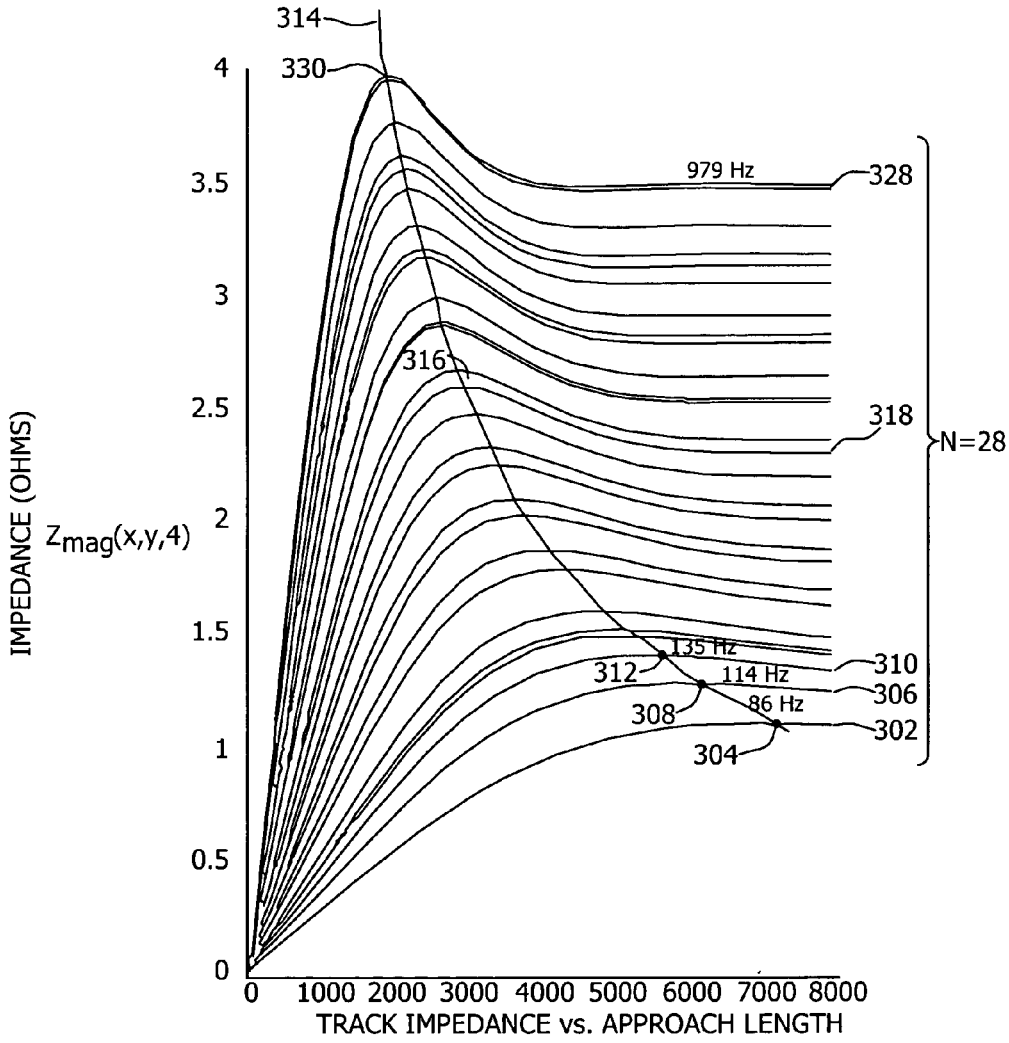
FIG. 3 is an exemplary graph of the impedance of the railroad track as a function of the distance and the operating frequency between 80 Hz and 1,000 Hz.

FIG. 3 is a graph that illustrates the electrical impedance magnitude of the railroad track 102 as a function of frequency and distance. FIG. 3 illustrates the impedance characteristics of twenty eight (28) typical frequencies utilized by prior art crossing track circuit systems which operate in the frequency band of 80 Hz to 1,000 Hz. The number of operating frequencies is limited as a function of the available total frequency bandwidth, the bandwidth required to detect each operating frequency and the bandwidth required for separation between operating frequencies. Moving on a curve from right to left for a given operating frequency is analogous to a train moving towards the crossing thereby reducing the surveillance distance of the approach track circuit. As the train approaches the road crossing 108, the axle of the train shunts the transmission prior to the shunt 120 or 124 and thereby decreases the length of the approach track circuit.

The area of each curve where the slope decreases linearly as the track length decreases is the usable track length for a given frequency to effectively detect train motion and/or position. The usable approach length for a given frequency is the area to the left of the peak line 314. The impedance characteristics of the rail for each operating frequency results in a maximum usable length or "peak" on the impedance curve. At distances greater than where the peak occurs (as indicated by the region to the right of peak line 314), the impedance curve changes slope and the impedance decreases with increases in track length until the impedance reaches a constant impedance level that is independent of distance. At this point, the track appears to be a transmission line with a constant or characteristic impedance. The track length associated with the peak is the maximum track length operable at a given frequency for a train detection system, as the detection system measures the change (increase or decrease) of the impedance over time to determine the movement of a train, the direction of travel and the distance of the train from the road crossing. This requires that the impedance is linear in nature as a function of distance. Distances that are to the right of the peak curve 314, result in the inability of the system to detect train movement, as the impedance does not linearly decrease as the train moves towards the crossing. Only systems designed to operate at selected operating frequencies at distances that are less than the distance of the impedance peak provides for the proper detection of train movement.

FIG. 3 also illustrates that the lower frequencies are best for longer track surveillance distances as the peak of the lower frequencies occurs at greater distances. However, the higher frequencies provide a more accurate means of detecting trains because higher frequencies result in higher track impedance levels which can be detected with greater accuracy and provide greater variations of impedance per unit distance. Generally, the operating frequency for a particular approach track circuit is chosen as the highest frequency possible to drive a given track length. For example, for a track of maximum required detection range, impedance line 302 at the operating frequency of 86 Hz results in a peak at 304 which equates to a maximum operating distance of slightly over 7,000 feet. However, the value of the impedance of the rail is less than 1.15 Ohms and as the distance decreases, the change in the impedance value between 7,000 feet to 2,000 feet results in a reduction of 0.55 Ohms, which is only a change of 0.11 Ohms per 1,000 feet. In comparison, at the higher operating frequency of around 565 Hz as illustrated by curve 318, the peak detection distance is 3,000 feet producing an impedance of 2.65 Ohms. A decrease of 1,000 feet to 2,000 feet for this operating frequency results in a decrease of 0.3 Ohms that is a three fold increase in sensitivity. This is further illustrated by curve 328 at the operating frequency of 979 Hz, which has a peak impedance of 4.0 Ohms at 2,000 feet. The impedance of the rail at 979 Hz drops to 2.8 Ohms at 1,000 feet for a sensitivity of 1.2 Ohms per 1,000 feet. This increased sensitivity provides for improved determination of the location and speed of the train traveling along track 102. It should be noted that FIG. 3 illustrates one embodiment of the track impedance as a function of frequency and distance. However, the relationship of track impedance to length and frequency will vary due to other external factors such as track material, operating conditions, track conditions, and ballast conditions.

Railroad crossing warning equipment has limitations with regard to the level of electrical noise that can exist within the operating environment such as to enable the system to reliably operate. As discussed above, the track contains noise from many sources. In fact, some track sections contain sources of electrical noise that are significant enough to provide an unsuitable transmission environment for the reliable operation of a railway road crossing detection system. One example, is in railroad operations with electrified rails, e.g., rails that carry electrical DC or AC energy to power the trains that operate on the rails. Electrified rails are often electrified with 50 Hz or 60 Hz AC power. In such situations, where prior art systems operate at the lower frequencies, the systems are not capable of filtering the necessary track circuit signals from the electrification power signals along with the associated harmonics and noise in order to make an accurate determination of train presence and motion. Without the ability to adequately filter the AC power noise signals and associated harmonics, the receiving system will not be able to adequately detect the transmitted track circuit signals.

Additionally, stray electronic signals from adjacent crossings or adjacent railroad tracks "bleed" over into unintended railroad tracks through leakage in the ballast. This signal leakage can negatively effect the operation of the railroad grade crossing system. Due to leakage and approach track circuit overlaps, railroads are required to manage the operating frequencies of the various systems by alternating the selection of operating frequencies between adjacent crossings or adjacent railroad tracks. Such frequency management requires selecting operating frequencies with appropriate track distance capabilities but with necessary bandwidth separation based on the filtering capabilities of analog bandpass filters for each frequency. The goal of selecting frequencies is to reduce the chance that the leakage signal will affect the adjacent system. This is often manageable in the cases where the same railroad operator designs and operates all adjacent track, but becomes an administrative problem where adjacent tracks are designed and owned by another railroad operator.

In one embodiment of the present invention, active phase cancellation noise reduction provides for reduced received noise from the signals present on the railroad track. This is especially beneficial in removing track circuit noise from external high power lines such as 60 Hz or 50 Hz power lines. By using active phase cancellation, a band-pass filter is tuned to the frequency of an interference signal. The filtered noise signal is shifted 180 degrees and added back to the source signal. This results in the phase-shifted noise canceling the noise present in the source signal, thereby eliminating the interference from the signal. This improves the sensitivity of the receiver thereby improving the determination of the received signal and also results in a cleaner signal that results in improved signal detection.

Figure 4:
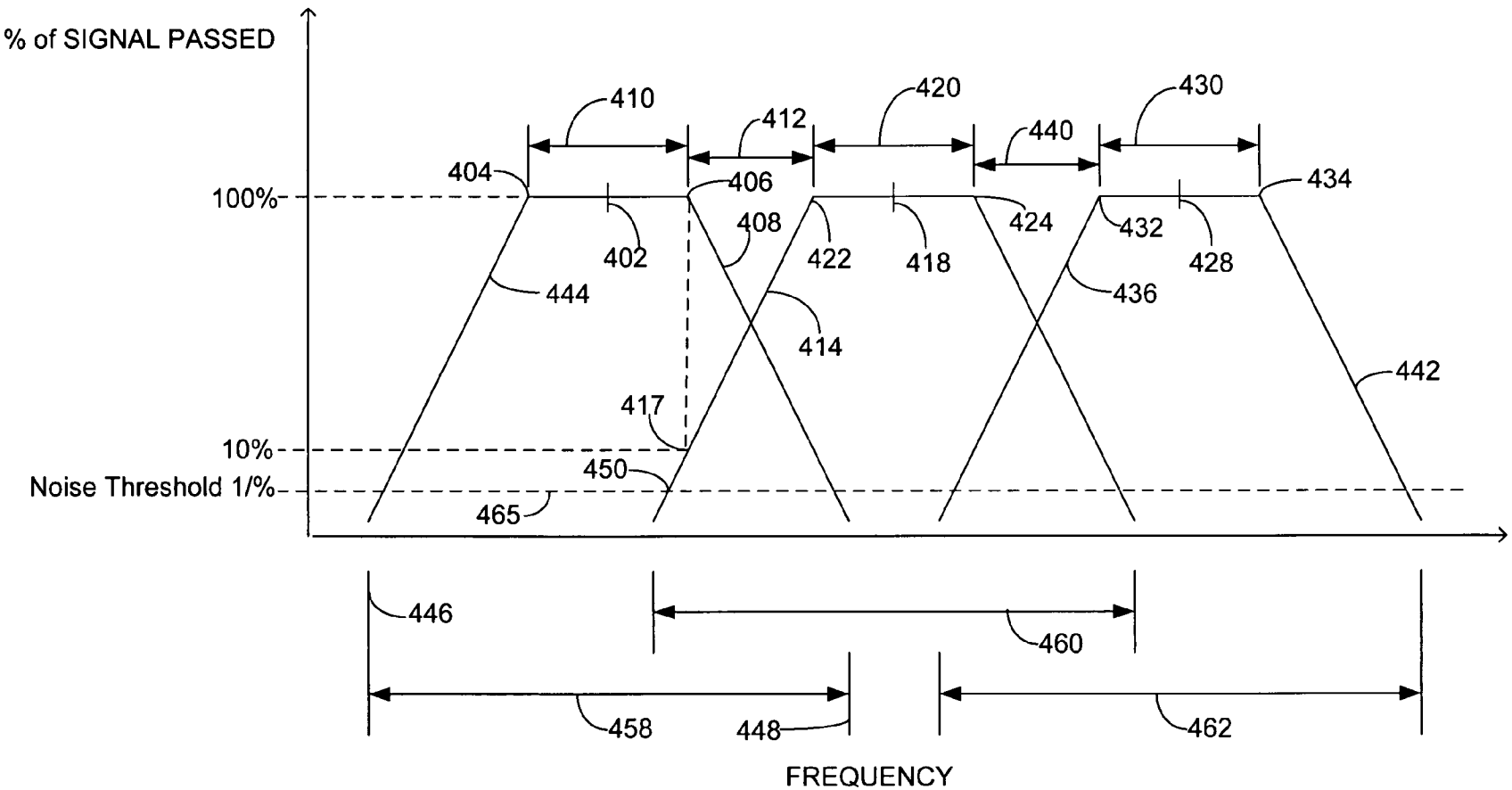
FIG. 4 is an illustration of a prior art railway approach track circuit receiving system filter design for three typical operating frequencies.

Typically, bandpass filters are used to recover signals at the frequency of interest and block signals of unwanted frequencies. Performance characteristics of bandpass filters include the bandwidth of the passband (e.g., 410, 420, and 430), the bandwidth of the stopband (e.g., 458, 460, and 462), the "sharpness" of the filter which is often defined as the slope of the transition region and the percent of energy of frequencies outside the stopband that are effectively blocked. Signals operating in the passband typically pass 100 percent of the signals e.g., do not attenuate the signal. As illustrated in FIG. 4, the passband for an analog filter 410 is shown from 404 to 406 and the associated stopband 458 is from the frequency at 446 to the frequency at 448. For the analog filter shown, signals at frequencies outside of the stopband only pass 0.1–0.01 percent of the signal or attenuate 99.9–99.99 percent of the signal. The analog filter has a wide range of frequencies between the passband and the stopband. This frequency range is referred to as the transition region, represented as one example for filter 410 in FIG. 4 as line 444 and line 408. Signals with frequencies within the transition region are attenuated by various levels based on the slope of the transition region curve. The more signal attenuated at a particular frequency or the smaller the desired transition region, the larger and more complex the analog filter required, hence the more components required and increased cost.

The bandpass filter at one particular track circuit frequency may not be effective enough at blocking the next track circuit frequency due to the analog bandpass filter not being "sharp" enough, e.g. the slope of the transition region not being as steep as required thereby not attenuating to the desired level of signals for frequencies outside of the passband. The lack of sharpness in analog filters creates the operational need for many operating track circuit frequencies for situations involving adjacent crossings operating compatibility. Additionally, in high noise environments, the signal attenuation in the stopband or the transition region may not be sufficient to enable prior art systems from operating accurately at the required track circuit frequency.

Prior art railway road crossing systems employ analog bandpass filters to pass the frequencies of interest, while blocking the other received frequencies. These analog bandpass filters are typically tuned during manufacturing to a frequency of operation based on the designed operating frequency for a particular railway crossing system's deployment. In more recent prior art, programmable analog bandpass filters were developed where the frequency response of the filter could be altered during operation by software control. Typically multiple stages of analog filters are cascaded to provide increased noise rejection. In either case, analog bandpass filters introduced errors due to tolerance variances, temperature variations, and errors due to cascaded stage mismatches.

The limitation of traditional railroad crossing warning equipment regarding immunity to electrical noise is the rejection characteristics of the analog filters. The typical threshold for noise immunity in prior art systems is 1% of the signal of interest, as indicated by 465 in FIG. 4. Any signal above 1% of the signal level of the frequency of interest, or any frequency inside the area of the filter response intersected by the 1% noise immunity line (with same or greater strength as signal of interest) will adversely affect the ability of the warning system to precisely predict train movement. As discussed, the characteristics of train detection systems that utilize analog filters are less than desirable in high noise environments and in environments where multiple frequencies are required due to operating frequency separation requirements.

Digital filters are programmable, and can easily be changed without affecting circuitry (hardware). In one embodiment, filtering is provided by a digital signal processor such that the filtering is implemented by software. This embodiment saves cost and board space as compared to prior art analog bandpass filters. Digital filters according to the present system are immune to fluctuations of component tolerances or temperature changes. The performance of the digital filters versus the cost to implement this function with analog filtering provides a significant improvement over the prior art. Digital filtering provides improved sharpness within the transition region and therefore more attenuation of signals at frequencies outside the passband than is available from practical analog filters. For example, increased rejection of frequencies around the target frequency is possible thereby allowing for previously incompatible adjacent frequencies to be used in a single implementation. This results in the possible elimination of required bandwidth for crossing system operations that provides improved operations, reduced frequency interference with other operational systems and ease of frequency coordination and administration. Improved filtering also enables systems to be designed and operated with reduced frequency spacing between operating frequencies and enables systems to be designed and implemented with closer spacing of adjacent frequencies. This is especially important where there are a number of adjacent and or overlapping approach track circuits that, due to the high speeds of the operating trains and the close proximity of multiple track circuits, it is desirable to utilize an increased number of track circuits operating at lower frequencies such as in the 80 Hz to 150 Hz operating frequency range.

In one embodiment, the present system has a digital signal processor (DSP) that employs a finite impulse response (FIR) or infinite impulse response (IIR) digital filter to limit the effects of out of band noise and interference on the measurement of the signal. In order to provide a sharp transition region between frequencies from filter passband to stopband and sufficient rejection in the stopband within a reasonable number of filter coefficients, the DSP filter employs a multi-rate technique to allow filtering at a sampling rate lower than the data sampling rate. The finite impulse response filter is implemented by a convolution of the source signal sample and the impulse response of the filter to be employed. The samples of the filter impulse response are referred to as filter coefficients. The filter is designed such that the transition region becomes more abrupt as the stopband rejection is increased, as the passband ripple is reduced, and as the sampling rate for the source signal increases. In these situations, the number of filter coefficients increases. The more filter coefficients required increases the required storage and processing time. Additionally, data overflow and quantization effects may cause distortion of the signal. On the other hand, accuracy in determining the amplitude of the source signal is largely dependent on sampling the source at a high rate, thus increasing the number of filter coefficients required. In order to balance these two conflicting requirements, one embodiment provides for a multi-rate filter design. In this embodiment, the source signal is sampled at a high sampling rate, and decimated by retaining only every nth sample, thereby effectively decreasing the sampling rate. The finite impulse response filter is run on this lower sampling rate, reducing the number of filter coefficients required. At the output of the filter, the filtered data is interpolated by a factor of N, thereby restoring the original high sample rate. Finally, an anti-image finite impulse response is run on the interpolated data to eliminate spectral images of the interpolation frequency. Because the anti-image filter has less stringent requirements than the main data filter, it requires relatively few coefficients. The net result is a very high quality finite impulse response filter that can be run on the data with dramatically fewer coefficients than would be required without the multi-rate techniques.

Another embodiment of the present system utilizes filtering that does not fluctuate or change over time, or as a result of changes in the temperature or operating voltage. For example, filtering provided by a digital signal processor (DSP) that is consistent with this system utilizes software filtering that has consistent attenuation characteristics independent of operational conditions.

Another embodiment provides over-sampling, filtering, signal averaging, and correlation to provide for higher accuracy of the received signal and more confidence in the data used to determine presence and movement of a train within the crossing surveillance area.

Another embodiment of the present system applies a correlation scheme to recover modulated signal from the environment including the noise or signals from adjacent railroad crossing warning systems. By cross-correlating the received signal with the signal that was transmitted, the noise or other unwanted signals is reduced relative to the signal of interest thereby increasing the signal to noise ratio.

Another embodiment of the present system is applying matched filter correlation technique to maximize signal to noise ratio and thus give greater accuracy of the amplitude of the recovered signal.

Another embodiment of the present invention is to over-sample the received signal to increase the signal-to-noise ratio and provide greater accuracy of recovered signal. Over-sampling the signal also allows the requirements for an external anti-alias filter, as needed to reject signals above Nyquist frequency, to be relaxed. This provides for improvement in the design for the anti-alias filter, and results in lower required cost.

Another embodiment of the present invention applies signal averaging so that sum of coherent signals builds up linearly with number of measurements taken while noise builds up only as square root of number of measurements. This provides increased signal-to-noise ratio.

Another embodiment of the system provides for a gated reception by the receiver such that the received island signal is only received during a gated window that corresponds to the period that the island signal is transmitted along with a period of time required from the transmission from transmitter to receiver. By gating the island signal receivers to only receive the island signal during timeframes when the island signal is being transmitted, the probability of incorrectly responding to a different island circuit transmitter is reduced.

Another embodiment of the present system uses a code word embedded in the track signal in place of random frequencies and cycle counts to uniquely identify a signal. A selected code word is modulated onto a signal transmitted to the track via a modulation scheme such as Quadrature Phase Shift Key. Received signals from the track are demodulated and examined for the presence of an embedded code word. If one is found, it is compared to the code word stored on the transmitting unit. The input signal is rejected if the code word does not match. This improves the existing arrangement by deterministically authenticating a signal, rather than depending on random correlation. Additionally, the capability of placing code words on the track signal allows one crossing control unit to pass information to an adjacent unit for status or incoming train alert.

Referring now to FIG. 4, an analog bandpass filter passes frequencies that are within a defined range on either side of the operating frequency. The frequency spectrum of the bandpass filter where 100% of the signal is passed is called the filter's passband. FIG. 4 illustrates three typical operating frequencies of railroad crossing track circuits, 86 Hz 402, 114 Hz 418 and 135 Hz 428. A first analog bandpass filter 410 detects the 86 Hz track circuit signal with a low end of the passband being 404 and the high end being 406. Passband 410 is centered on the center operating frequency 402 and passes 100 percent of all frequencies between 404 and 406. An example is an 86 Hz filter with a passband of 16 Hz, which passes 100 percent of all frequencies between 404 which would be 78 Hz and 406 which would be 94 Hz. Passband filters with very narrow transition regions are difficult to produce and are very costly. However, it would be desirable to utilize a filter with a transition region that is sufficiently narrow to uniquely pass 100 percent of the desired frequency while sufficiently attenuating all other frequencies. A train detection system equipped with such a narrow bandpass filter would provide for improved train detection and would enable the use of operating frequencies that are significantly closer to other operating frequencies. This is especially the case where operating in a high noise environment or in the presence of numerous other track circuits.

Analog filters are not perfect filters and as such do not attenuate 100 percent of the signal that is outside of the passband. This is illustrated in FIG. 4 by the slope of the leading edge 444 and trailing edge 408 of filter 410. Leading edge 444 and trailing edge 408 attenuates at least 99.9 percent of the signal at frequencies that are outside of the stopband 458. However, an increasing percent of the signal level are passed at frequencies in the transition region that are closer to the passband. The area of the filter curve where the percent of the signal passed decreases is referred to as "rolloff" or the transition region. The sharpness of this transition region as reflected by the slope of the curve directly affects the ability of the receive filters to reject frequencies that are close to the passband frequencies. Analog filters used in prior art train detection systems have a transition region rolloff of 20–100 db per decade of frequency. The sharper the rolloff, the larger and more costly the required analog filters. There are practical limits to the size of these analog filters based on cost and PC board space requirements.

The impact of the limitations of analog bandpass filters negatively affects the ability to receive and detect the desired operating frequency and the received signal characteristics. The analog filter limitations therefore negatively affect the ability of the train detection system to determine the impedance and therefore determine the presence, movement, and speed of a train. The analog filter limitations also negatively affect the ability to use multiple operating frequencies within the desired operating spectrum.

Referring again to FIG. 4, a second operating frequency 114 Hz is shown at 418. A second analog filter 420 has a passband from 422 to 424. The limitations of the analog filter result in a leading edge 414 and a trailing edge 426. The passband of the second filter 420 is different than the passband of the first filter 410 and is separated by a separation band 412 to provide for the detection of frequencies only within the passband of the desired filter. However, as each analog filter is imperfect and passes signals operating at frequencies that are outside of the passband and in the transition regions as defined by the trailing edge 408 of the first filter 410 and the leading edge 414 of the second filter 420, the separation band is in some cases, not large enough to sufficiently attenuate frequencies associated with an adjacent bandpass filter.

Compatible operating frequencies are often chosen due to the limitations of the analog filters to attenuate frequencies outside of their passband. Adjacent analog filters provide a separation band 412, such that the lower adjacent filters only pass a predefined tolerance level of the signal associated with frequencies that overlap with an adjacent higher frequency filter. In this illustration, a typical overlap intersection at the 10 percent level is shown by point 417. In this example, a system operating with an 86 Hz bandpass filter would allow 10% of a signal at frequency 422 (which is the lower passband frequency of the 114 Hz filter) to pass through. With a noise threshold of 1%, this means that approach track circuits operating at 114 Hz are not compatible with overlapping approach track circuits at 86 Hz. As a result, the next higher or lower frequency would need to be used. Operating systems require that an adjacent operating track circuit not have an overlap of its filter passband above the 1% noise threshold with an adjacent operating track circuit. As such, the operating frequency 402 with filter 410 could not be utilized in the same vicinity as operating frequency 420. The next compatible operating frequency with frequency 402 would be operating frequency 428 with bandpass filter 430 with a passband from 432 to 434. In this case, it can be seen that filter 430 transition band 436 intersects filter 410 passband 406 below the 1% noise threshold. However, the utilization of operating frequency 428 may not be the optimal choice for that deployment, as it may not provide the necessary or desired surveillance distance required by maximum speed trains in that area.

Figure 5:
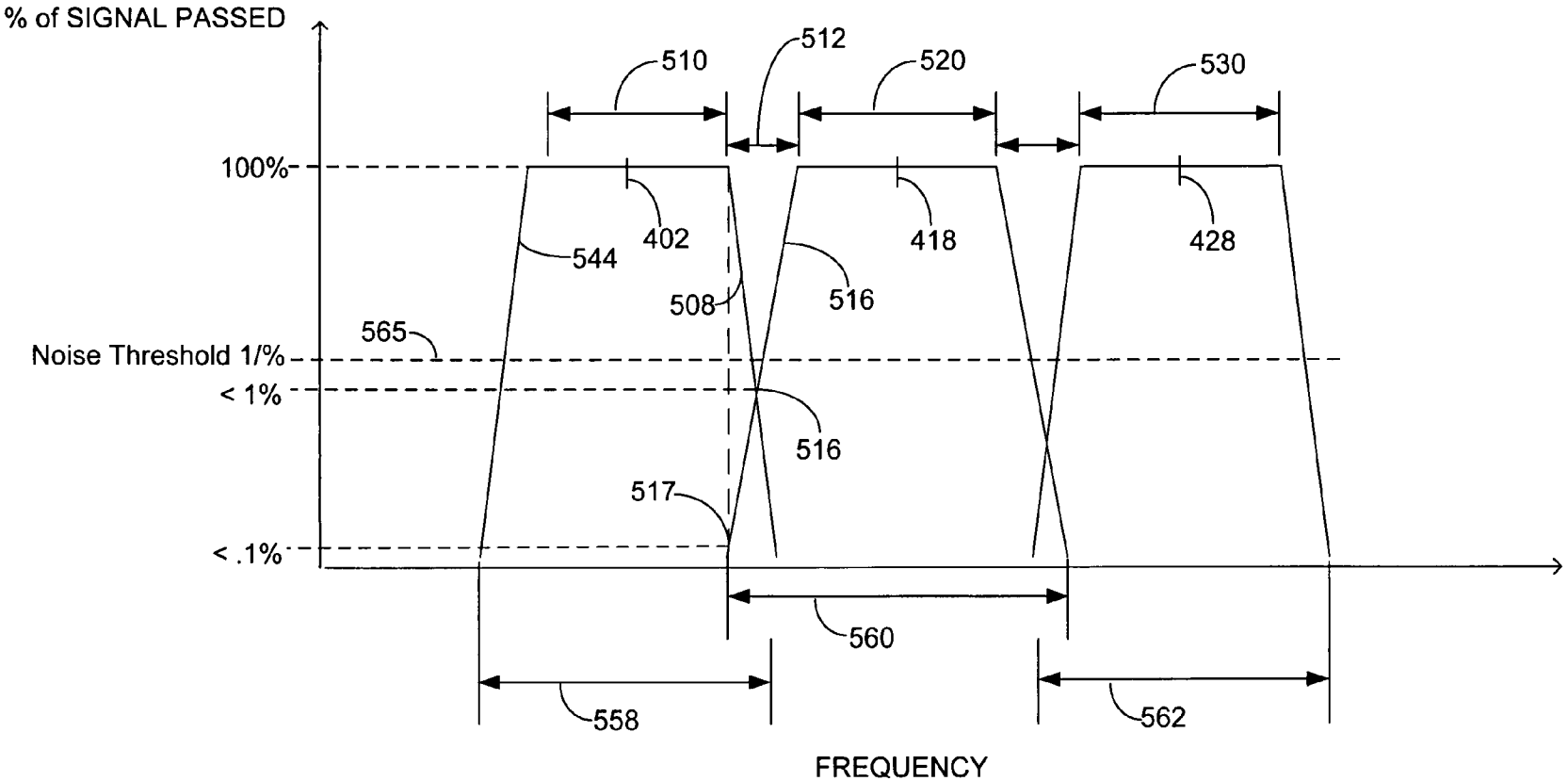
FIG. 5 is an illustration of the effective filter design for an approach track circuit consistent with one aspect of the invention.

The present system utilizes a digital signal processing (DSP) system to provide both a narrower filter passband sharper transition band rolloff, and an improved filtering system with improved attenuation outside of the passband. As shown in FIG. 5, a first filter 510 consistent with the present system has significantly improved attenuation outside of the passband as illustrated by the increased slope of both the leading edge 544 and the trailing edge 508 of the transition regions. Attenuation characteristics outside of the passband as illustrated in FIG. 5 are not practically achievable with analog bandpass filters. The increased attenuation in these transitions regions provide improvements to the operation and detection of trains.

An additional improvement is the increased signal to noise ratio of the signal that is provided to the signal detection system. By providing a strong signal with higher signal to noise ratio within the frequencies of the passband, the detection of the signal characteristics significantly improves. The detection system has a cleaner signal to analyze and to make determinations of the voltage and current of the transmitted operating signal, and therefore the determination of the impedance. Another improvement of the present system is that the separation band between operating frequencies can be reduced due to the increased slope of attenuation in the transition region. As shown in FIG. 5, the level of overlap between the first filter 510 and the second filter 520, as indicated by point 515 occurs below the noise threshold level of 1% indicated by 565.

A filter design consistent with the present system provides for reductions in bandwidth of the required separation bands as a result of the improved sharpness in the transition regions. As such, operating frequencies may be utilized that are closer together than had previously been capable. Additionally, this makes adjacent frequencies usable on overlapping approaches, where they were previously incompatible. As shown in FIG. 5, with the increased slope of the transition regions, the separation between two filters may be reduced. For example, the separation band 512 between filter 510 and filter 520 currently illustrates a passband to transition region crossing at point 517 at the <0.1 percent signal pass rate. With this intersection below the 1% noise threshold level, this means that the separating band 512 could be reduced and therefore operating frequency 418 could be reduced, e.g., could utilize a frequency that is closer to the frequency of 402. As shown in FIG. 3, in the operating frequency band of 80 Hz to 1,000 Hz, the prior art was limited to 28 operating frequencies due in large part to the limitations of analog filters. In contrast, a present system will provide for a reduction of required bandwidth of separation bands. This alone will result in the increase in the number of usable frequencies.

Another operational improvement of the present invention is the improvements in the filters to provide for improved attenuation of noise and interference, especially noise or signals associated with electric power that operates at 50 Hz or 60 Hz. By providing improved filtering of these power signals, track circuits utilizing lower operating frequencies, and therefore longer track length, may now be deployed on approach track circuits that are in harsh electrical or noisy environments that were heretofore not available for approach track circuit systems. This includes deployment on electrified track systems.

Another operational improvement consistent with the present system is the reduction in the bandwidth of the filter passband. As discussed above, analog filters are limited in their ability to filter an individual frequency and therefore pass frequencies between a high-end frequency and a low-end frequency, thereby defining the passband. One embodiment of the present system provides for significant reductions in the passband required to detect the transmitted frequency. Referring again to FIG. 5, passband 510 is centered on operating frequency 402. One embodiment of the present invention provides that passband 510 is narrower in bandwidth than the required passband as shown in FIG. 4 associated with operating frequency 402, e.g., passband 410. The prior art system as shown in FIG. 4 requires a passband such as 410 that is plus or minus 10 percent of the operating frequency. For example, at the operating frequency of 86 Hz, the total passband is approximately 16 Hz, which is from 78 Hz to 94 Hz, e.g., plus or minus 8 Hz. In contrast, in one embodiment of the present invention, the passband is reduced to plus or minus 3 percent of the operating frequency. In such an embodiment, the passband 410 for the 86 Hz operating frequency would be from 83 Hz to 89 Hz, a significant reduction in the required bandwidth of the passband of the filter. This by itself provides for a substantial improvement in the signal to noise ratio that is analyzed to determine the operating transmission characteristics.

Another improvement according to one aspect of the present invention results from both the reduction in the passband bandwidth and the required separation bandwidth, e.g., the reduction in the bandwidth of the associated filter stopband (e.g., 553, 560, and 562). By reducing the stopband associated with each filter, frequencies that are significantly closer together now become compatible for use in adjacent systems. Referring again to FIG. 5, intersection of upper passband 510 of frequency 402 and transition band 516 of frequency 418 occurs below the 1% noise threshold. As such, an operating frequency that is less than frequency 418 could be utilized as an operating frequency and still be compatible with the track circuit utilizing frequency 402 whereas in prior art even frequency 418 was not compatible with frequency 402 in overlapping approaches.

By reducing the bandwidth of the passband, the detection system is provided with a narrower frequency range and cleaner signal with less noise from which the signal characteristics are determined. The narrower signal contains less noise and the detection of the signal is improved. This results in the ability to operate train detection systems in harsh environments that include other signals, considerable noise and harmonics. With narrower passband filtering, noise from power systems, electrification systems, cab signaling systems and adjacent and overlapping track circuit systems is more effectively attenuated prior to the signal being provided to the detection system.

Another operational improvement that results from reduced passband bandwidth of receiving filters is the ability to utilize operating frequencies that are closer together. In one embodiment with a 50 percent reduction in the passband bandwidth from the prior art of 16 Hz to 8 Hz, the number of available operating frequencies between 80 Hz and 1,000 Hz increases from 28 operating frequencies to 42, a 50 percent increase. An operational improvement of the present system is an increase in the number of available frequencies is that selection of frequencies may be made that are more optimal for a particular approach track distance and maximum train speed. For example, the present system provides for more operating frequencies in the lower end of the frequency spectrum which enables longer approach lengths. Additionally, frequencies below 80 Hz are now usable as operating frequencies due to the improvements in attenuating other signals such as 50 Hz or 60 Hz electric power signals. By utilizing frequencies less than 80 Hz, as illustrated by FIG. 3, longer approach track lengths are possible. This is especially desirable as railway operators are designing systems with increased train speeds, that require approach lengths longer than before.

Also, the improvement of the present invention provides for a reduction in the total number of frequencies required as operating frequencies of adjacent and/or overlapping track circuits may be "reused" more often and in closer proximity than prior art operating frequencies.

The present system provides for a significant improvement in the operating characteristics of the track circuit transmission system by reducing the total harmonic distortion introduced to the railroad track 102 by the track circuit transmitter 110. As discussed above related to noise, the tracks as a transmission medium contain considerable noise. Some of the noise is actually created by the prior art track circuit transmission systems through the creation, amplification and transmission of signals containing many harmonics. In fact, systems that transmit signals on the rails, including railroad grade crossing systems and coded cab signaling systems, are responsible for most of this harmonic noise content. Prior art track circuit systems produce considerable harmonic content. Significant levels of noise due to harmonics make it difficult to recover a systems own signal resulting in unreliable operation or inaccurate warning time. In some cases, the crossing warning equipment cannot operate with other track equipment or vice versa, due to noise interference.

Prior art track circuit transmitters generate a square wave signal that is filtered by analog filters to remove higher frequency harmonics. However, the filtered signal, while approximating a sine wave, includes many harmonics due to the limitations of analog filters in completely removing the harmonics and to thereby produce a pure sine wave signal. The filtered signal including the many harmonics is provided to an amplifier for transmission on the rail. The present invention provides the generation of a high fidelity sine wave with little to no harmonics from a sine wave generator using a digital signal processor. In one embodiment, the total harmonic distortion (THD) of the present system is less than one (1) percent for all frequencies between 80 Hz and 1,000 Hz. By using digital signal processors to generate high fidelity signals that are then amplified and transmitted on the track, the track transmission system has minimal noise associated with harmonics of the operating frequencies of the track circuit signals. In one embodiment, a digital signal processor cycles a sine wave generator circuit through a table of sine wave values at the specified rate to create a high fidelity sine wave at the frequency desired. Other embodiments for the production of a true sine wave with minimal distortion include sine wave calculation, sine wave look-up from ROM, direct digital synthesis (DDS), and recursive filtering and interpolation. The resulting sine wave signal is amplified by a low distortion power amplifier, and the signal that is applied to the tracks has very little harmonic content. This solution enables railroad crossing equipment to easily detect and recover its transmitted signal resulting in improved reliability and better accuracy. It also allows the crossing warning equipment to be compatible with a broader range of track equipment, by not generating interfering harmonic frequencies.

In another embodiment of the present system, the system provides improved control of approach and island track circuit gain, enabling real time adjustments to the gain during operation of the system due to external and environmental factors. While the voltage and current levels transmitted on the track are typically calibrated or determined during initial system setup, the operating environment for the track circuit equipment is harsh, often experiencing significant variations in operating temperatures and conditions, including impacts of snow, ice, rain and salt on the impedance of the track and on the leakage that occurs from adjacent tracks. The present system provides for automated gain adjustments during operation to ensure the system continues to operate at optimal transmission levels and such that the impedance curve and received data analysis is consistent.

The present system provides for significant improvements to track circuit frequency management and operational methods for design, implementation and operations of track circuit systems. It is critical to the installation that the frequencies of operation for adjacent crossings do not interfere with each other. In order to obtain the most amount of flexibility for installations, railroads require that crossing protection systems have a large number of operating frequencies to choose from. As discussed above, the present system provides for an increase in the number of available operating frequencies within the operating band of 80 Hz to 1,000 Hz. In fact, the number of usable operating frequencies provided by the present system will increase due to the decreased bandwidth of the passband and the separation band. Additionally, the present system provides for the utilization of frequencies that are lower than previously used which not only increases the number of operating frequencies but also increases the maximum distance available for approach track circuits. Where prior art systems were limited in the number of available and compatible operating frequencies especially in the lower frequencies which are required for extremely long approach lengths, the present system's increase in operating and compatible operating frequencies in the lower frequencies ranges improves the design of track circuits thereby enabling more designs that are optimal for the particular track and train speed and less dependence on external factors such as adjacent signals and overlapping systems. More track circuits may now be implemented using longer approach distances, which allows crossing protection for faster moving trains.

Referring again to FIG. 2, in metropolitan areas where there are many streets, track circuit overlaps occur. In these cases, or in cases where the approaches are just in close proximity (either on the same rail, or on an adjacent rail in double or triple track), each crossing's approach track circuit must operate at a different compatible frequency. As previously discussed, the availability of compatible frequencies is limited by the ability of the receiver circuits to pass the appropriate frequency while rejecting unwanted frequencies. In some cases with prior art systems, operating frequency selection requires that the system designer select a frequency that is less than optimal for a required track condition or required track circuit surveillance distance. This incompatibility in part has created the need in the prior art for many operating frequencies between the desired operating frequencies of 80 Hz and 1,000 Hz. As reflected in FIG. 3, some prior art systems have 28 defined operating frequencies in the 80 Hz to 1,000-Hz band in order to create enough compatible combinations for most operating railroad systems. However, where train speeds are high, the total number of compatible frequencies is considerably less than 28 as only lower frequencies provide the necessary longer track lengths.

The improved filtering and detection capabilities of the present system will significantly reduce the required frequency coordination between various track circuits, whether in adjacent, overlapping, or multi-track situations. The increase in the number of operating frequencies over the total operating frequency band will decrease the requirement for tuned shunts to terminate the approach track circuits as the variation of operating frequencies will be reduced.

A system, according to one embodiment of the invention, provides for the system determination of the optimal approach track circuit and island track circuit frequencies for a particular operational implementation. The system selects the optimal operating frequencies based on an automatic analysis of transmitted test signals onto an operating railroad track that includes noise and transmission signals from external signal sources, including power lines and other adjacent and/or overlapping track circuit equipment. The system determines the optimal operating frequency for a required detection distance as a function of the quality of the received signal in light of the noise and operating characteristics. As noted above, the exact frequency is not limited to predefined frequencies or channels, but is selected from an unlimited number of operating frequencies within the frequency band.

In one embodiment, the present system automatically determines the thresholds in the number of recovered and validated island burst signals that determine whether the island should be declared as active or not active. The thresholds are determined based on the system analysis of test wave forms that are transmitted on the track for a particular track circuit implementation as a function of the quality of the signal in light of noise and transmission characteristics of the track as a transmission media.

Similarly, in another embodiment the system provides for the automated determination of thresholds in the number of recovered and validated island burst signals used for the purpose of adjusting the time between successive island signal bursts so that the response time of the system to a train entering or leaving the island is optimized.

In another embodiment, automatic calibration of the approach and island track circuits is provided during initial system implementation such that the transmitted power is optimized for the particular track conditions. The system generates test track circuit signals for either the island track signal or the approach track signal, or both, and analyzes the received signals to optimize the signal to noise ratio such that the receiver optimally detects the transmitted signal and can optimally determine the presence and movement of a train. This improves the operations of the system and reduces the design and setup time. Furthermore, the system provides fine tune adjustments to the output power during operation to provide consistent received signal quality over the life of the system, independent of changes that result from external factors such as weather, noise, temperature, ballast conditions, and the presence of foreign substances such as ice, snow or salt.

Figure 6:
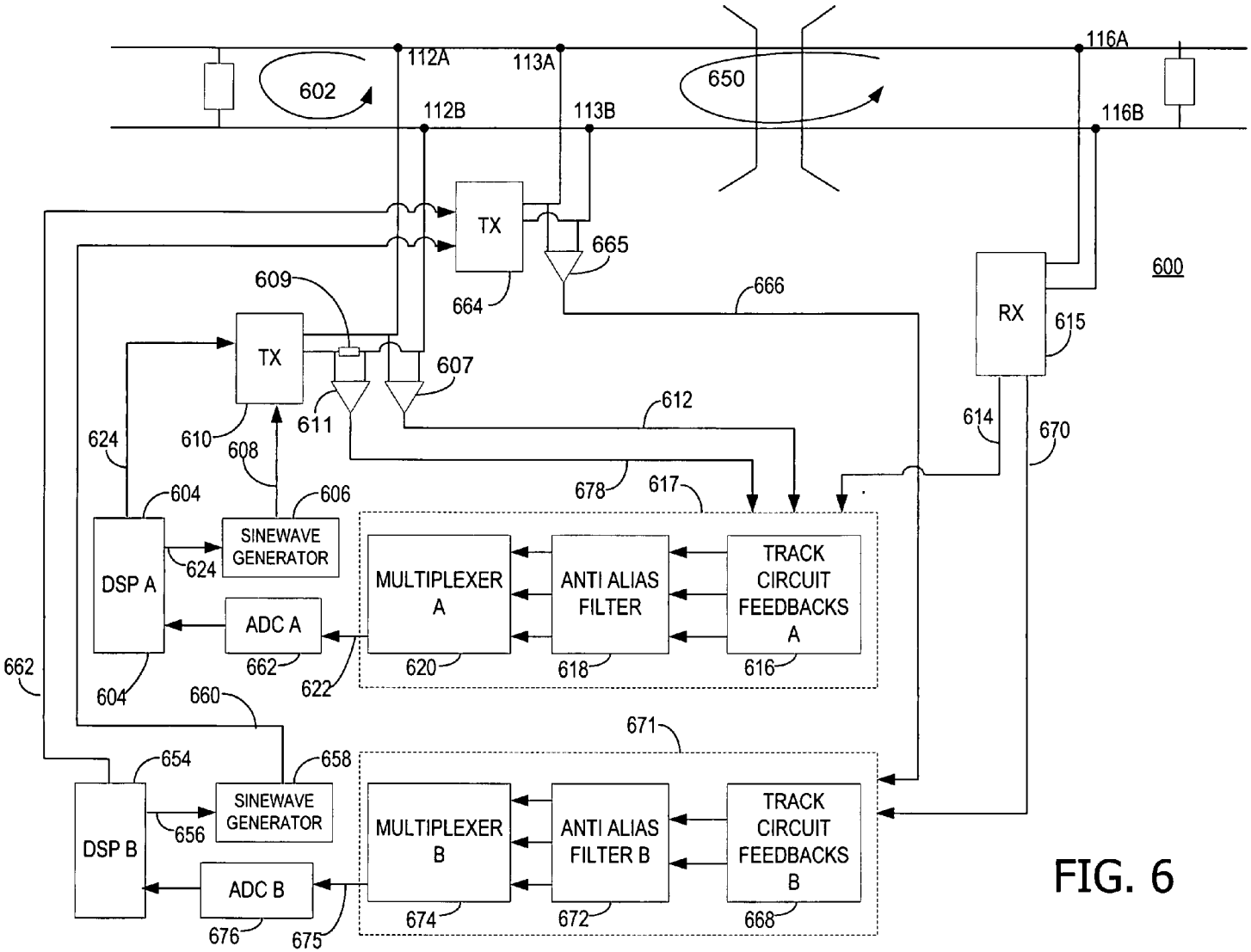
FIG. 6 is an exemplary circuit design of a combined approach track circuit and island track circuit system.

Referring now to FIG. 6, a system schematic of one embodiment of a track circuit 600 encompassing an approach track circuit 602 (e.g., 128) and an island track circuit 650 (e.g., 110) is illustrated. One embodiment utilizes dual digital signal processors (DSPs). A first digital signal processor (DSP A) 604 provides a sine wave output signal 626 to sine wave generator 606 to produce an approach sine wave 608 that is a true sine wave with minimal harmonic content. The first DSP 604 provides an approach gain signal 624 that provides necessary gain control for the approach transmitter 610. Approach sine wave 608 is provided to the approach transmitter 610 that amplifies the approach sine wave signal 608 based on approach gain signal 624 and transmits the amplified approach signal on the rail 102 via the transmitter leads 112A and 112B.

The approach track circuit 602 generates feedback 612 indicative of the voltage transmitted along the rail 102, and a feedback 678 indicative of the transmitted current. Differential amplifiers can be used to provide the transmitted voltage feedback 612 and the transmitted current feedback 678. For example, a differential input amplifier 607 is connected to lead 112A and lead 112B, and the output provides feedback voltage 612 representing the voltage of the transmitted approach signal. A resistor 609 is interposed in series with output lead 112B, and a differential input amplifier 611 has its inputs connected to the respective ends of resistor 609 in order to provide a feedback current signal 678 representative of the value of the constant current applied to the track. A received voltage feedback 614 represents the transmitted approach signal voltage picked up by the receiver via leads 116A and 116B. In one embodiment, the receiver 615 is another differential input amplifier having its inputs connected to the tie points 116A and 116B, and the output signal from amplifier is a voltage representative of the received approach signal. Feedbacks 612, 678 and 614 are provided to the data acquisition system 617 comprised of a track circuit feedback 616, anti-alias filter 618, and multiplexer 620. As known to those skilled in the art, multiplexing involves sending multiple signals or streams of information at the same time in the form of a single, complex signal (i.e. multiplex signal). In this case, the anti-alias filter 618 receives the transmitted voltage feedback 612, the transmitted current feedback 678, and the received voltage feedback 614 to eliminate, for example, noise in the received feedback signals. The multiplexer 620 is coupled to the anti-alias filter and multiplexes the filtered first transmitted voltage feedback 612, the filtered first transmitted current feedback 678, and the filtered first received voltage feedback 614 to generate a multiplexed analog signal 622. The multiplexed analog signal 622 is provided to an analog to digital converter 662 where the analog signal is sampled and digitized and converted into first digital signals that correspond to the transmitted voltage feedback 612, the transmitted current feedback 678, and the received voltage feedback 614. The first digital signals are digitally bandpass filtered within the DSP 604 and the filtered data is processed to determine signal level and phase. In particular, the first digital signals are processed to determine the frequency and magnitude of the transmitted voltage feedback 612, the transmitted current feedback 678, and the received voltage feedback 614. Processing the first digital signals also includes digitally filtering the second digital signals to determine if the frequency of the received voltage feedback 614 is within a first passband range. If the received voltage feedback 614 is determined to be within a first passband range, the DSP 604 uses the determined signal level (i.e., magnitude) and phase data to calculate the overall track impedance, which in turn determines the presence and motion of a train within the approach track circuit 128. In an alternate embodiment, the DSP 604 provides the data that includes the signal level and signal phase to a different processor (not shown) that calculates the overall track impedance, which in turn determines the presence and motion of a train within the approach track circuit 128.

Similarly, a second digital signal processor (DSP B) 654 generates a sine wave output signal 656 to a second sine wave generator 658 to produce an island sine wave signal 660. Island sine wave signal 660 is provided to island transmitter 664 that amplifies the island sine wave signal 660 based on island gain control signal 663 provided by the second DSP 654. This amplified island signal is transmitted onto rail 102 via the isolated transmitter leads 113A and 113B. Of course in different embodiments, the island track circuit 110 may utilize the same set of transmit leads.

The island track circuit 650 generates feedback 666 indicative of the transmitted voltage and generates feedback 670 indicative of the received voltage. In this case, a differential input amplifier 665 can be connected to leads 113A and 113B, and the output provides feedback voltage 666 representing the voltage of the transmitted approach signal. The received voltage feedback 670 represents the transmitted island signal voltage picked up by the receiver via leads 116A and 116B. The transmitted voltage feedback 666, and the received voltage feedback 670 are provided to the data acquisition system 671 comprised of a track circuit feedback 668, anti-alias filter 672, and multiplexer 674 to generate multiplexed analog signals 675. The second multiplexed analog signals 675 are provided to an analog to digital converter 676 where the signals are digitized and converted into second digital signals. The second digital signals are digitally bandpass filtered within DSP 654 and the filtered data is processed for determination of the signal level. In particular, the second digital signals are processed to determine the frequency and magnitude of the transmitted voltage feed back 666 and the received voltage feedback 670. Processing the second digital signals also includes digitally filtering the second digital signals to determine if the frequency of the received second signal is within a second passband range adjacent to the first passband frequency range. If the frequency of the received second signal is determined to be within a second passband range, the DSP 654 uses the determined signal level (i.e., magnitude) to determine train presence within the island 118.

The approach track circuit 602 generates feedback 612 indicative of the voltage transmitted along the rail 102, and a feedback 678 indicative of the transmitted current. Differential amplifiers can be used to provide the transmitted voltage feedback 612 and the transmitted current feedback 678. For example, a differential input amplifier 607 is connected to lead 112A and lead 112B, and the output provides feedback voltage 612 representing the voltage of the transmitted approach signal. A resistor 609 is interposed in series with output lead 112B, and a differential input amplifier 611 has its inputs connected to the respective ends of resistor 609 in order to provide a feedback current signal 678 representative of the value of the constant current applied to the track. A received voltage feedback 614 represents the transmitted approach signal voltage picked up by the receiver via leads 116A and 116B. In one embodiment, the receiver 615 is another differential input amplifier having its inputs connected to the tie points 116A and 116B, and the output signal from amplifier is a voltage representative of the received approach signal. Feedbacks 612, 678 and 614 are provided to the data acquisition system 617 comprised of a track circuit feedback 616, anti-alias filter 618, and multiplexer 620. As known to those skilled in the art, multiplexing involves sending multiple signals or streams of information at the same time in the form of a single, complex signal (i.e. multiplex signal). In this case, the anti-alias filter 618 receives the transmitted voltage feedback 612, the transmitted current feedback 678, and the received voltage feedback 614 to eliminate, for example, noise in the received feedback signals. The multiplexer 620 is coupled to the anti-alias filter and multiplexes the filtered first transmitted voltage feedback 612, the filtered first transmitted current feedback 678, and the filtered first received voltage feedback 614 to generate a multiplexed analog signal 622. The multiplexed analog signal 622 is provided to an analog to digital converter 662 where the analog signal is sampled and digitized and converted into first digital signals that correspond to the transmitted voltage feedback 612, the transmitted current feedback 678, and the received voltage feedback 614. The first digital signals are digitally bandpass filtered within the DSP 604 and the filtered data is processed to determine signal level and phase. In particular, the first digital signals are processed to determine the frequency and magnitude of the transmitted voltage feedback 612, the transmitted current feedback 678, and the received voltage feedback 614. Processing the first digital signals also includes digitally filtering the second digital signals to determine if the frequency of the received voltage feedback 614 is within a first passband range. If the received voltage feedback 614 is determined to be within a first passband range, the DSP 604 uses the determined signal level (i.e., magnitude) and phase data to calculate the overall track impedance, which in turn determines the presence and motion of a train within the approach track circuit 128. In an alternate embodiment, the DSP 604 provides the data that includes the signal level and signal phase to a different processor (not shown) that calculates the overall track impedance, which in turn determines the presence and motion of a train within the approach track circuit 128.

Another embodiment of the present system is to sample the signal recovered from the track at an integer multiple of the frequency of the transmitted signal. Referring to FIG. 6, the DSP A 604 and sine wave generator 606 serve to create an approach sine wave signal 608 of frequency Af. To aid in the digital signal processing and ultimately increase the accuracy of the received signal, the DSP A 604 provides a programmable clock in the form of approach sample clock (not shown) to the analog-to-digital converter ADC A 662 that is programmed to N times Af, where N is an integer value (i.e., 1, 2, 3 . . . etc.). The same method is used for the island circuit where DSP B 654 and sine wave generator 658 create an island sine wave signal 660 of frequency Ai. The DSP B 654 provides a programmable clock as island sample clock (not shown) to ADC B 676 programmed to Q times Ai, where Q is an integer value (i.e., 1, 2, 3 . . . etc.). N and Q are selected based upon the DSP FIR and/or IIR filter design requirements. This allows for the filter coefficients to be optimized to recover the transmitted signal in question and the resulting data acquisition and filtering of noise from the signal to be achieved by changing only the DSP software.

Another embodiment of the present system is that the anti-alias filters are also programmable via the DSP software. Referring again to FIG. 6, DSP A 604 presents a programmable clock 682 to anti alias filter A 602 that is programmed to M times Af. Similarly DSP B 654 provides a programmable clock to anti alias filter B 672 programmed to P times Ai. In one embodiment, the anti alias filter circuits re realized using a switched-capacitor filter device. M and P are selected based upon the device requirements and anti alias filter (AAF) requirements for rejecting out of band signals. This allows the desired bandpass filtering to be achieved by changing only the DSP software.

Another embodiment of the present system is that by making the data acquisition sampling clocks and anti alias filter clocks programmable, only one configuration of hardware is needed to realize and support the entire range of frequencies for a railroad grade crossing system. This reduces cost for the manufacturer in the form of a reduced number of systems that have to be manufactured and stocked and also for the user in that a fewer number of spare systems have to be purchased and maintained.

While the improved system and technique of this application for the generation and detection of signals sent along railroad rails has been described in conjunction with railroad crossings, and more particularly in connection with the detection of trains approaching such crossings, the system and technique of this invention may be used in other railroad wayside applications. For example, the system and technique may be used for train detection in connection with the operation of interlocking equipment for switches between tracks.

Further, the system and technique may be used in track circuit applications in which the transmitter and receiver are located at spaced locations along the rails to detect the presence of a train in the interval between the transmitter and receiver. They may also be used for cab signaling in which the transmitter is located along the rail and the receiver is located on-board a locomotive for transmitting information from wayside to the locomotive, such as signal aspect information.

Figure 7:
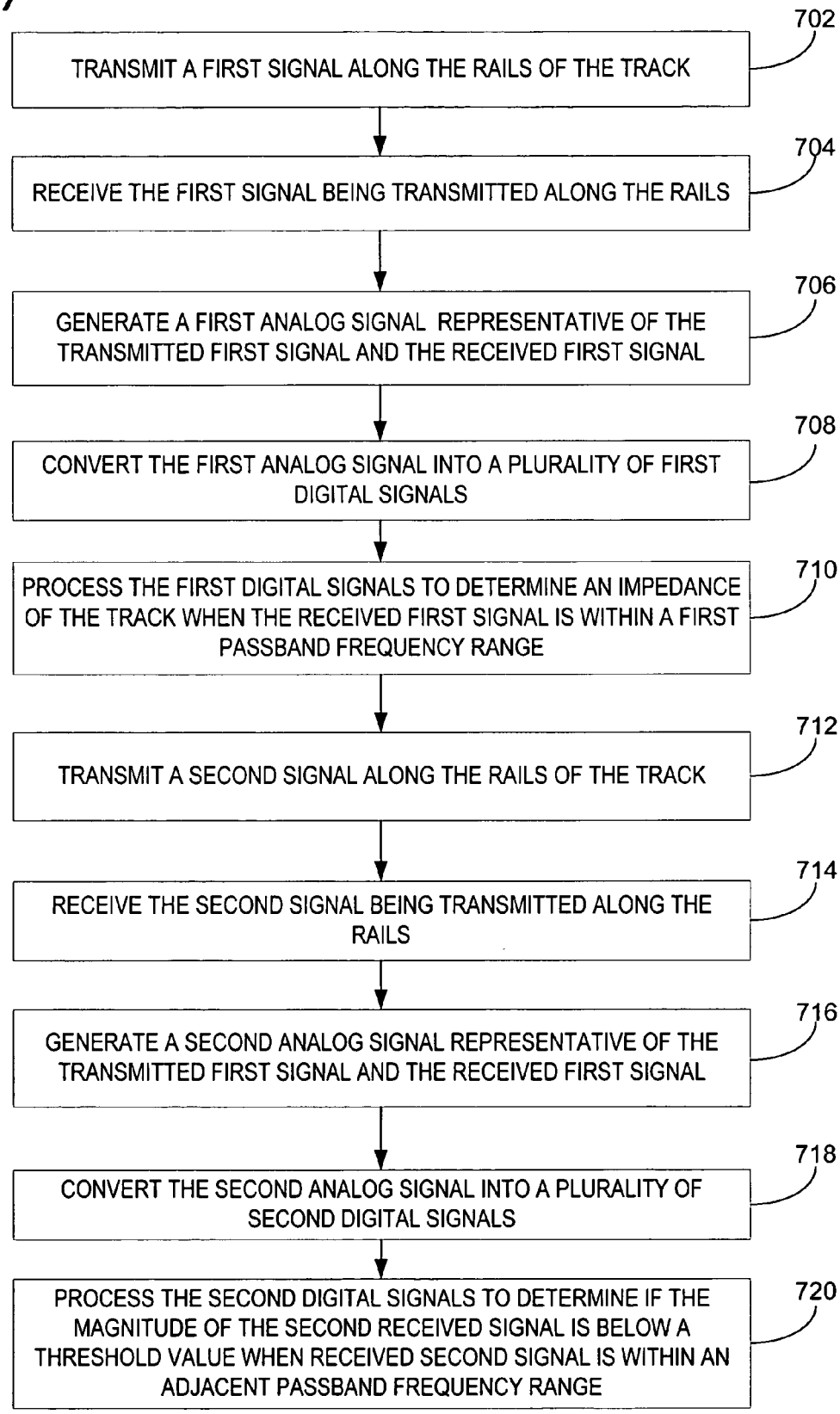
FIG. 7 is an exemplary flow chart illustrating a method for detecting the presence and/or position of a railway vehicle within a detection area of a railroad track consistent with one embodiment of the invention.

Referring now to FIG. 7, an exemplary flow chart illustrates a method for detecting the presence and/or position of a railway vehicle within a detection area of a railroad track according to one embodiment of the invention. At 702 a first signal having a predetermined magnitude and a predetermined operating frequency is transmitted along the rails of the railroad track. The first signal being transmitted along the rails is received by, for example, a receiver at 704. At 706 a first analog signal that is representative of the transmitted first signal and the received first signal is generated. The first analog signal is converted into a plurality of first digital signals that correspond to the transmitted first signal and the received first signal at 708. At 710 the first digital signals are processed to determine the frequency and magnitude of the transmitted first signal and the received first signal. Processing the first digital signals includes digitally filtering the first digital signals to determine if the frequency of the transmitted first signal is within a first passband frequency range. The processing also includes determining the impedance of the track as an indication of the presence and/or position of a train within an approach detection area when the received first signal is within the first passband frequency range. At 712 a second signal having a predetermined magnitude and a different predetermined operating frequency is transmitted along the rails of the railroad track. The second signal being transmitted along the rails is also received by, for example, the receiver at 714. At 716 a second analog signal that is representative of the transmitted second signal and the received second signal is generated. The second analog signal is converted into a plurality of second digital signals that corresponds to the transmitted second signal and the received second signal at 718. At 720 the second digital signals are processed to determine the frequency and magnitude of the transmitted second signal and the received second signal. Processing the second digital signals includes digitally filtering the second digital signals to determine if the frequency of the transmitted second signal is within a second passband range adjacent to the first passband frequency range. The processing also includes determining whether the magnitude of the received second signal is above or below a threshold value as an indication of the presence of a train within an island detection area when the received second signal is within the second passband frequency range. In one embodiment, the threshold value corresponds to a predetermined percentage of the transmitted voltage.

For example, for a transmitted voltage of 100 mili-volts (mV), the threshold value may be 80% of the transmitted voltage (i.e. 80 mV). The 20 mV drop corresponds to expected resistance losses that occur during transmission of the signal over the rails. If the received second signal has a magnitude below 80 mV, it is assumed that a train is present in the island detection area. Alternatively, if the received second signal has a magnitude above 80 mV, it is assumed that a train is not in the island detection area. The above voltage magnitude and threshold value are for illustrative purposes only, and it is contemplated that various voltage magnitudes and/or threshold values could be used when implementing the invention.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A train detection system for detecting the presence and/or position of a railway vehicle within a detection area of a railroad track, the railroad track having a pair of rails and an identified impedance within the detection area, and wherein the presence and/or position of the railway vehicle within the detection area changes the impedance of the track, said train detection system comprising:

a first transmitter connected to the rails of the railroad track for transmitting along the rails a first signal having a predetermined magnitude and a predetermined operating frequency;

a receiver connected to the rails for receiving the first signal;

a first data acquisition unit coupled to the first transmitter and the receiver and responsive to the transmitted first signal and the received first signal to generate first multiplexed analog signal representing the transmitted first signal and the received first signal, wherein the first data acquisition unit includes:

a first feedback circuit for detecting a first transmitted voltage signal applied to the rails via the first transmitter, a first current signal transmitted along the rails via the first transmitter, and a first received voltage signal received by the receiver;

a first filter coupled to the first feedback circuit for filtering the detected first transmitted voltage signal, the detected first transmitted current signal, and the detected first received voltage signal; and a first multiplexer coupled to the first filter for multiplexing the filtered first transmitted voltage signal, the filtered first current signal, and the filtered first received voltage signal to generate the first multiplexed analog signals, and wherein the processor calculates the impedance in the approach detection area as a function of the difference between first transmitted voltage signal and the first received voltage signal, and the first transmitted current signal;

a first converter for converting the first multiplexed analog signal into a plurality of first digital signals corresponding to the transmitted first signal and the received first signal; and a processor responsive to the first digital signals for processing the first digital signals to determine the frequency and magnitude of the transmitted first signal and the received first signal.

2. The train detection system of claim 1, wherein the processor is a digital signaling processor (DSP), and wherein the processor processes the first digital signals to determine an impedance of the track as an indication of the presence and/or position of a train within the detection area.

3. The train detection system of claim 2, wherein the DSP provides a sine wave output signal to a sine wave generator to produce an approach sine wave signal, and wherein the DSP provides an approach gain signal that provides necessary gain control for the first transmitter, and wherein the first transmitter amplifies the approach sine wave signal based on approach gain signal and transmits the amplified approach signal on the rail.

4. The train detection system of claim 1, wherein the processor provides a sharper transition band rolloff.

5. The train detection system of claim 1 ,wherein the processor employs a finite impulse response (FIR) digital filter or an infinite impulse response (IIR) digital filter for processing the first digital signals.

6. The train detection system of claim 1, wherein the processor processes the first digital signals to determine if the frequency of the received first signal is within a first passband frequency range, wherein the first passband frequency range is a function of the frequency of the transmitted first signal, and wherein the processor processes the first digital signals to determine the impedance of the track when the determined frequency of the received first signal is within the first passband frequency range.

7. The train detection system of claim 6, wherein the receiver receives a second signal being transmitted along the track and having a different predetermined operating frequency.

8. The train detection system of claim 7, wherein the second signal is generated by external sources, said external sources including a power transmission lines and/or adjacent railroad tracks.

9. The train detection system of claim 7, wherein a second transmitter is connected to the rails of the railroad track for transmitting along the rails a second signal having a predetermined magnitude and a different predetermined operating frequency, wherein the receiver receives the second signal, and wherein a second data acquisition unit coupled to the second transmitter and the receiver is responsive to the transmitted second signal and a received second signal to generate second multiplexed analog signals representing the transmitted second signal and the received second signal.

10. The train detection system of claim 9 wherein the processor processing the first digital signals is a first digital signaling processor and further including a second digital signaling processor for processing the second digital signals.

11. The train detection system of claim 9 further comprising a second converter for converting the second multiplexed analog signals into a plurality of second digital signals, wherein the processor is responsive to the second digital signals for processing the second digital signals to determine a magnitude of the received second signal as an indication of the presence of a train within the detection area.

12. The train detection system of claim 11, wherein the processor processes the second digital signals to determine if the frequency of the received signal is within a second passband frequency range adjacent to the first passband frequency range, wherein said second passband frequency range is a function of the frequency of the transmitted second signal, and wherein the processor processes the second digital signals to determine if the magnitude of the received second signal is above or below a threshold value when the determined frequency of the received second signal is within the second passband frequency range.

13. The train detection system of claim 12, wherein the detection area includes an approach detection area and an island detection area, said processor processing the first digital signals to determine the impedance of the track as an indication of the presence and/or position of the train within the approach detection area when the determined frequency of the received first signal is within the first passband frequency range, and said processor processing the second digital signals to determine if the magnitude of received second signal is below the threshold value as an indication of the presence of the train within the island detection area when the determined frequency of the received second analog signal is within the second passband frequency range.

14. The train detection system of claim 12, wherein a separation band defines a range of frequencies between the first passband frequency range and the second passband frequency range, and wherein the processor is configured to minimize the separation band and to increase the number operating frequencies for simultaneous use in a single detection system.

15. The train detection system of claim 12, wherein the second data acquisition unit includes:

a second feedback circuit for monitoring a second transmitted voltage signal applied to the rails via the second transmitter and a second received voltage signal received by the receiver;

a second filter coupled to the second feedback circuit for filtering the second transmitted voltage signal and the second received voltage signal; and a second multiplexer coupled to the second filter for multiplexing the filtered second transmitted voltage signal and the filtered second received voltage signal to generate the second multiplexed analog signals, wherein the processor processes the filtered second transmitted voltage signal and the filtered second received voltage signal to determine if the received second signal is above or below a threshold value, and wherein a received second signal below the threshold value indicates the presence of the train within the island detection area.

16. The train detection system of claim 12, wherein a bandwidth of the first passband frequency range corresponds to approximately plus or minus three percent of the predetermined operating frequency, and wherein a bandwidth of the second passband frequency range corresponds to approximately plus or minus three percent of the different predetermined operating frequency.

17. A method for detecting the presence and/or position of a railway vehicle within a detection area of a railroad track, the railroad track having a pair of rails and an identified impedance within the detection area, and wherein the presence and/or position of the railway vehicle within the detection area changes the impedance of the track, comprising:

transmitting along the rails a first signal having a predetermined magnitude and a predetermined operating frequency;

transmitting along the rails a second signal having a predetermined magnitude and a different predetermined operating frequency;

receiving the first signal being transmitted along the rails;

receiving the second signal being transmitted along the rails;

generating a first analog signal representative of the transmitted first signal and the received first signal;

generating a second analog signal representing the transmitted second signal and the received second signal;

converting the first analog signal into a plurality of first digital signals corresponding to the transmitted first signal and the received first signal;

converting the second analog signal into a plurality of second digital signals corresponding to the transmitted second signal and the received second signal; and processing the first digital signals to determine the frequency and magnitude of the transmitted first signal and the received first signal to determine an impedance of the track as an indication of the presence and/or position of a train within an approach detection area, and processing the second digital signals to determine if a magnitude of the received second signal is below a threshold value as an indication of the presence of a train within an island detection area.

18. The train detection system of claim 17, wherein processing the first digital signals includes determining a speed of a train within the detection area as function of a rate of change of the impedance.

19. The method of claim 17, wherein processing the first digital signals includes digitally filtering the first digital signals to determine if the frequency of the received first signal is within a first passband frequency range which is a function of the frequency of the transmitted first signal, and wherein processing further includes processing the first digital signals to determine the impedance of the track when the determined frequency of the received first signal is within the first passband frequency range.

20. The method of claim 17, wherein processing the second digital signals includes digitally filtering the second digital signals to determine if the frequency of the received second signal is within a second passband frequency range adjacent to the first passband frequency range, wherein the second passband frequency range is a function of the frequency of the transmitted second signal, and wherein processing the second digital signals further includes processing the second digital signals to determine if the magnitude of the received second signal is below the threshold value when the determined frequency of the received second signal is within the second passband frequency range.

21. A train detection system for detecting the presence and position of a railway vehicle within a detection area of a railroad track, the railroad track having a pair of rails and an identified impedance within the detection area, and wherein the presence and/or position of the railway vehicle within the detection area changes the impedance of the track, said train detection system comprising:

a first transmitter connected to the rails of the railroad track for transmitting along the rails a first signal having a predetermined magnitude and a predetermined operating frequency;

a second transmitter connected to the rails of the railroad track for transmitting along the rails a second signal having a predetermined magnitude and a different predetermined operating frequency;

a receiver connected to the rails for receiving the first and second signals;

a first data acquisition unit coupled to the first transmitter and the receiver and responsive to the transmitted first signal and the received first signal to generate first multiplexed analog signals representing the transmitted first signal and the received first signal;

a second data acquisition unit coupled to the second transmitter and responsive to the transmitted second signal and the received second signal to generate second multiplexed analog signals representing the transmitted second signal and the received second signal;

a first converter for converting the first multiplexed analog signals into a plurality of first digital signals corresponding to the transmitted first signal and the received first signal;

a second converter for converting the second multiplexed analog signals into a plurality of second digital signals corresponding to the transmitted second signal and the received second signal;

a first digital signaling processor responsive to the first digital signals for processing the first digital signals to determine if the frequency of the received first signal is within a first passband frequency range, wherein said first passband frequency range is a function of the frequency of the transmitted first signal;

a second digital signaling processor responsive to the second digital signals for processing the second digital signals to determine if the frequency of the received second signal is within a second passband frequency range adjacent to the first passband frequency range, wherein said second passband frequency range is a function of the frequency of the transmitted second signal; and an external processing system responsive to the first digital signals for processing the first digital signals to determine the frequency and magnitude of the transmitted first signal and the received first signal to determine an impedance of the track as an indication of the presence and/or position of a train within an approach detection area when the received first signal is within the first passband frequency range, and wherein said the external processing system is responsive to the second digital signals for processing the second digital signals to determine if the magnitude of second signal is below a threshold value as an indication of the presence of a train within an island detection area when the received second signal is within the second passband frequency range.

22. The train detection system of claim 21, wherein the first data acquisition unit includes:

a first feedback circuit for detecting a first transmitted voltage signal applied to the rails via the first transmitter, a first current signal transmitted along the rails via the first transmitter, and a first received voltage signal received by the receiver;

a first filter coupled to the first feedback circuit for filtering the detected first transmitted voltage, the detected first current signal transmitted, and the detected first received voltage signal; and a first multiplexer coupled to the first filter for multiplexing the filtered first transmitted voltage signal, the filtered first current signal, and the filtered first received voltage signal to generate the first multiplexed analog signals, and wherein the external processing system processor calculates the impedance of the track in the approach detection area as a function of the difference between first transmitted voltage signal and the first received voltage signal, and the first transmitted current signal.

23. The train detection system of claim 21, wherein the second data acquisition unit includes:

a second feedback circuit for detecting a second transmitted voltage signal applied to the rails via the second transmitter and a second received voltage signal received by the receiver;

a second filter coupled to the second feedback circuit for filtering the detected second transmitted voltage and the detected second received voltage signal; and a second multiplexer coupled to the second filter for multiplexing the filtered second transmitted voltage signal and the filtered second received voltage signal to generate the second multiplexed analog signals.

24. The train detection system of claim 21, wherein a bandwidth of the first passband frequency range corresponds to approximately plus and minus three percent of the predetermined operating frequency, and wherein the bandwidth of the second passband frequency range corresponds to approximately plus and minus three percent of the different predetermined operating frequency.

25. The train detection system of claim 24, wherein a separation band defines to a range of frequencies between the first passband frequency range and the second passband frequency range, and wherein the first and second digital filters are configured to minimize the separation band and to increase the number of operating frequencies for simultaneous use in a single detection system.

* * * * *

UNITED STATES PATENT AND TRADEMARK OFFICE

CERTIFICATE OF CORRECTION

PATENT NO. : 7,254,467 B2
APPLICATION NO. : 10/743591
DATED : August 7, 2007
INVENTOR(S) : Fries et al.

It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 240 days Delete the phrase "by 240 days" and insert -- by 241 days --

Signed and Sealed this

Fifth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,254,467 B2
APPLICATION NO. : 10/743591
DATED : August 7, 2007
INVENTOR(S) : Fries et al.

It is certified that error appears in the above-identified patent and that said Letters Patent is hereby corrected as shown below:

On the Title Page of the patent, Section 75, Inventors:

"Robert M. Morris, Blue Springs, MO (US)"

should read

-- Robert M. Morse, Blue Springs, MO (US) --.

Signed and Sealed this

Tenth Day of November, 2009

David J. Kappos

David J. Kappos
*Director of the United States Patent and Trademark Office*